US011353813B2

(12) United States Patent
Suzuki et al.

(10) Patent No.: US 11,353,813 B2
(45) Date of Patent: Jun. 7, 2022

(54) FUSER DEVICE HAVING REDUCED ELECTROSTATIC OFFSET

(71) Applicant: NOK CORPORATION, Tokyo (JP)

(72) Inventors: Masaya Suzuki, Fujisawa (JP); Kenji Sasaki, Fujisawa (JP); Wataru Nemoto, Fujisawa (JP); Tomohiro Kondo, Fujisawa (JP)

(73) Assignee: NOK CORPORATION

( * ) Notice: Subject to any disclaimer, the term of this patent is extended or adjusted under 35 U.S.C. 154(b) by 0 days.

(21) Appl. No.: 17/280,954

(22) PCT Filed: Dec. 27, 2019

(86) PCT No.: PCT/JP2019/051383
§ 371 (c)(1),
(2) Date: Mar. 29, 2021

(87) PCT Pub. No.: WO2020/145191
PCT Pub. Date: Jul. 16, 2020

(65) Prior Publication Data

US 2021/0341862 A1 Nov. 4, 2021

(30) Foreign Application Priority Data

Jan. 11, 2019 (JP) ..... JP2019-003843

(51) Int. Cl.
*G03G 15/20* (2006.01)

(52) U.S. Cl.
CPC ..... *G03G 15/2057* (2013.01); *G03G 15/20* (2013.01); *G03G 15/2053* (2013.01);
(Continued)

(58) Field of Classification Search
CPC ..... G03G 15/2057; G03G 15/2064; G03G 2215/2016; G03G 15/2053; G03G 2215/2035; G03G 2215/2048
See application file for complete search history.

(56) References Cited

U.S. PATENT DOCUMENTS

2012/0195654 A1* 8/2012 Sakakibara ..... G03G 15/2042 399/333
2014/0356039 A1 12/2014 Sakai
(Continued)

FOREIGN PATENT DOCUMENTS

EP 3382457 A1 10/2018
JP H11-316508 A 11/1999
(Continued)

OTHER PUBLICATIONS

International Search Report (English and Japanese) of the International Searching Authority issued in PCT/JP2019/051383, dated Mar. 10, 2020; ISA/JP (6 pages).
(Continued)

*Primary Examiner* — Walter L Lindsay, Jr.
*Assistant Examiner* — Laura Roth
(74) *Attorney, Agent, or Firm* — Harness, Dickey & Pierce, P.L.C.

(57) ABSTRACT

A tubular fuser device rotates and is in contact with a sheet on which a positively charged toner image is formed to fix the toner image to the sheet. The fuser device includes a tubular substrate made of a metal, a rubber layer covering the outer periphery of the substrate, an adhesion layer covering the outer periphery of the rubber layer, and a surface layer made of a resin covering the outer periphery of the adhesion layer. In the fuser device, a charge decay ΔV at a moment 120 seconds after end of charging a surface of the surface layer to −1 kV is zero, and an electrostatic capacity per unit area C in a thickness direction of the fuser device is equal to or less than 3.30 pF/cm$^2$.

2 Claims, 9 Drawing Sheets

(52) U.S. Cl.
CPC . *G03G 15/2064* (2013.01); *G03G 2215/2016* (2013.01); *G03G 2215/2035* (2013.01); *G03G 2215/2048* (2013.01)

(56) References Cited

U.S. PATENT DOCUMENTS

| | | | | |
|---|---|---|---|---|
| 2017/0139359 | A1* | 5/2017 | Goto ..... | G03G 15/2057 |
| 2018/0239280 | A1 | 8/2018 | Takagi | |

FOREIGN PATENT DOCUMENTS

| | | | |
|---|---|---|---|
| JP | 2002-251090 | A | 9/2002 |
| JP | 2003-255734 | A | 9/2003 |
| JP | 2014-232229 | A | 12/2014 |
| JP | 2015-090469 | A | 5/2015 |
| JP | 2017-015784 | A | 1/2017 |
| JP | 2018-136412 | A | 8/2018 |

OTHER PUBLICATIONS

Notice of Reasons for Refusal for corresponding Application No. JP 2020-565718 dated Jun. 22, 2021 with English translation (8 Pages).

* cited by examiner

Fig. 11A

| | | | SAMPLE 1 | SAMPLE 2 | SAMPLE 3 | SAMPLE 4 | SAMPLE 5 | SAMPLE 6 |
|---|---|---|---|---|---|---|---|---|
| FUSER BELT ELEMENTS | SLIDE LAYER 12 | MATERIAL | PTFE | PTFE | PTFE | PTFE | PTFE | PTFE |
| | | THICKNESS (μm) | 12 | 12 | 12 | 12 | 12 | 12 |
| | SUBSTRATE 11 | MATERIAL | NICKEL | NICKEL | NICKEL | NICKEL | NICKEL | NICKEL |
| | | THICKNESS (μm) | 40 | 40 | 40 | 40 | 40 | 40 |
| | PRIMER LAYER 13 | MATERIAL | SILICONE RUBBER-BASED | SILICONE RUBBER-BASED | SILICONE RUBBER-BASED | SILICONE RUBBER-BASED | SILICONE RUBBER-BASED | SILICONE RUBBER-BASED |
| | | THICKNESS (μm) | 2 | 2 | 2 | 2 | 2 | 2 |
| | RUBBER LAYER 14 | MATERIAL | NON-CONDUCTIVE SILICONE RUBBER | NON-CONDUCTIVE SILICONE RUBBER | NON-CONDUCTIVE SILICONE RUBBER | NON-CONDUCTIVE SILICONE RUBBER | NON-CONDUCTIVE SILICONE RUBBER | NON-CONDUCTIVE SILICONE RUBBER |
| | | THICKNESS (μm) | 285 | 285 | 300 | 300 | 1000 | 800 |
| | ADHESION LAYER 15 | MATERIAL | NON-CONDUCTIVE SILICONE RUBBER-BASED | NON-CONDUCTIVE SILICONE RUBBER-BASED | NON-CONDUCTIVE FLUORORESIN-BASED | NON-CONDUCTIVE FLUORORESIN-BASED | NON-CONDUCTIVE SILICONE RUBBER-BASED | NON-CONDUCTIVE SILICONE RUBBER-BASED |
| | | THICKNESS (μm) | 15 | 15 | 10 | 2 | 15 | 15 |
| | SURFACE LAYER 16 | MATERIAL | ION-CONDUCTIVE PFA | ION-CONDUCTIVE PFA | INSULATIVE PFA | INSULATIVE PFA | INSULATIVE PFA | INSULATIVE PFA |
| | | THICKNESS (μm) | 30 | 30 | 30 | 30 | 30 | 30 |
| ELECTRIC FEATURES | ELECTROSTATIC CAPACITY PER UNIT AREA C ($pF/cm^2$) | | 8.14 | 8.14 | 7.98 | 8.18 | 2.68 | 3.30 |
| | CHARGE DECAY ΔV (kV) | | 0.58 | 0.1 | 0.25 | 0.2 | 0 | 0 |
| | CHARGE DECAY ΔV／THICKNESS t (V/μm) | | 1.51 | 0.26 | 0.63 | 0.52 | 0.00 | 0.00 |
| | RATIO Ct／ΔV(pF/Vμm) | | 539116612 | 3126876347 | 1257680556 | 1579515384 | | |
| ELECTROSTATIC OFFSET REDUCING EFFECT | | | GOOD | GOOD | GOOD | GOOD | GOOD | GOOD |

Fig. 11B

| | | | SAMPLE 7 | SAMPLE 8 | SAMPLE 9 | SAMPLE 10 | SAMPLE 11 |
|---|---|---|---|---|---|---|---|
| FUSER BELT ELEMENTS | SLIDE LAYER 12 | MATERIAL | PTFE | PTFE | PTFE | PTFE | PTFE |
| | | THICKNESS (μm) | 12 | 12 | 12 | 12 | 12 |
| | SUBSTRATE 11 | MATERIAL | NICKEL | NICKEL | NICKEL | NICKEL | NICKEL |
| | | THICKNESS (μm) | 40 | 40 | 40 | 40 | 40 |
| | PRIMER LAYER 13 | MATERIAL | SILICONE RUBBER-BASED | SILICONE RUBBER-BASED | SILICONE RUBBER-BASED | SILICONE RUBBER-BASED | SILICONE RUBBER-BASED |
| | | THICKNESS (μm) | 2 | 2 | 2 | 2 | 2 |
| | RUBBER LAYER 14 | MATERIAL | NON-CONDUCTIVE SILICONE RUBBER | NON-CONDUCTIVE SILICONE RUBBER | CONDUCTIVE SILICONE RUBBER | NON-CONDUCTIVE SILICONE RUBBER | NON-CONDUCTIVE SILICONE RUBBER |
| | | THICKNESS (μm) | 600 | 285 | 285 | 285 | 285 |
| | ADHESION LAYER 15 | MATERIAL | NON-CONDUCTIVE SILICONE RUBBER-BASED | NON-CONDUCTIVE SILICONE RUBBER-BASED | CONDUCTIVE SILICONE RUBBER-BASED | CONDUCTIVE SILICONE RUBBER-BASED | NON-CONDUCTIVE FLUORRUBBER-BASED |
| | | THICKNESS (μm) | 15 | 15 | 15 | 15 | 15 |
| | SURFACE LAYER 16 | MATERIAL | INSULATIVE PFA | INSULATIVE PFA | INSULATIVE PFA | PFA (INSULATIVE LAYER + CONDUCTIVE LAYER) | INSULATIVE PFA |
| | | THICKNESS (μm) | 30 | 30 | 30 | 30 | 30 |
| ELECTRIC FEATURES | ELECTROSTATIC CAPACITY PER UNIT AREA C ($pF/cm^2$) | | 4.30 | 8.20 | 20.49 | 15.57 | 7.90 |
| | CHARGE DECAY ΔV (kV) | | 0 | 0 | 0 | 0.07 | 0.05 |
| | CHARGE DECAY ΔV／THICKNESS t (V/μm) | | 0.00 | 0.00 | 0.00 | 0.18 | 0.13 |
| | RATIO Ct／ΔV(pF/Vμm) | | | | | 8543330121 | 6067200000 |
| ELECTROSTATIC OFFSET REDUCING EFFECT | | | BAD | BAD | BAD | BAD | BAD |

FUSER DEVICE HAVING REDUCED ELECTROSTATIC OFFSET

CROSS REFERENCE TO RELATED APPLICATIONS

This application is a U.S. National Phase Application under 35 U.S.C. 371 of International Application No. PCT/JP2019/051383, filed on Dec. 27, 2019, which claims priority to Japanese Patent Application No. 2019-003843, filed on Jan. 11, 2019. The disclosures of the above applications are expressly incorporated by reference herein in their entirety.

TECHNICAL FIELD

The present invention relates to fuser devices used in fuser apparatuses of an electrographic image forming apparatus.

BACKGROUND ART

A fuser apparatus of an electrographic forming apparatus (for example, a copying machine or a printer) pressurizes a charged toner on a moving sheet and fixes the toner to the sheet. Accordingly, the fuser apparatus is equipped with a pair of rolls (a fuser roll and a pressure roll) or with a fuser belt and pressure roll. In a fuser of the type with a fuser belt and a pressure roll, toner is permanently bonded to a sheet as the sheet passes through the nip between the fuser belt and the pressure roll (Patent Document 1). In this type, the fuser belt is pressed toward the pressure roll by a fuser roll or fixing pad to fuse the toner by heating. The fuser belt is reheated to a high temperature by a heating device.

BACKGROUND DOCUMENTS

Patent Documents

Patent Document 1: JP-A-2018-136412

SUMMARY OF THE INVENTION

In use of a fuser apparatus, it is desirable for toner images to be fixed to sheets without excess or deficiency of toner when the sheets pass through the nip. However, due to generation of static electricity, an excessive amount of toner may be attracted to a sheet, or conversely, toner may be repelled from the sheet. Such a phenomenon, referred to as electrostatic offset, causes a disturbance in an image to be formed.

Measures to reduce electrostatic offset have been attempted, for example, as disclosed in Patent Document 1.

A fuser device deployed after a developing unit for attaching a positively charged toner to a sheet fixes the toner to the sheet. In this fuser device, it is desired to further effectively reduce electrostatic offset.

Accordingly, the present invention provides a fuser device for fixing a positively charged toner image to a sheet, which can effectively reduce electrostatic offset.

A fuser device according to an aspect of the present invention is a tubular fuser device that rotates and is in contact with a sheet on which a positively charged toner image is formed to fix the toner image to the sheet. The fuser device includes a tubular substrate made of a metal, a rubber layer covering an outer periphery of the substrate, an adhesion layer covering an outer periphery of the rubber layer, and a surface layer made of a resin covering an outer periphery of the adhesion layer. A charge decay ΔV at a moment 120 seconds after end of charging a surface of the surface layer to −1 kV is zero. An electrostatic capacity per unit area C in a thickness direction of the fuser device is equal to or less than 3.30 $pF/cm^2$.

In this aspect, since the electrostatic capacity per unit area C in the thickness direction of the fuser device is sufficiently small, charging on the surface of the surface layer is reduced, and it is possible to effectively reduce the electrostatic offset.

A fuser device according to another aspect of the present invention is a tubular fuser device that rotates and is in contact with a sheet on which a positively charged toner image is formed to fix the toner image to the sheet. The fuser device includes a tubular substrate made of a metal, a rubber layer covering an outer periphery of the substrate, an adhesion layer covering an outer periphery of the rubber layer, and a surface layer made of a resin covering an outer periphery of the adhesion layer. A charge decay ΔV at a moment 120 seconds after end of charging a surface of the surface layer to −1 kV is greater than zero. A ratio Ct/ΔV of an electrostatic capacity per unit area C in a thickness direction of the fuser device to a value ΔV/t obtained by dividing the charge decay ΔV by a thickness t of the fuser device is equal to or less than $3.13\times10^9$ pF/Vμm.

In this aspect, since the charge decay ΔV is relatively large and the electrostatic capacity C is relatively small, a charging on the surface of the surface layer is reduced, and it is possible to effectively reduce the electrostatic offset.

BRIEF DESCRIPTION OF THE DRAWINGS

FIG. 11A is a table showing factors of various samples of the fuser device;

FIG. 11B is a table showing factors of various samples of the fuser device;

DESCRIPTION OF EMBODIMENTS

Hereinafter, an embodiment according to the present invention will be described with reference to the accompanying drawings. It is of note that the drawings are not necessarily to scale, and certain features may be depicted in exaggerated form or may be omitted.

An electrographic forming apparatus forms an image of toner (toner image) on a sheet of paper that is a transported recording medium. Although details of the image forming apparatus are not shown, the image forming apparatus includes a photoconductor drum, a charger, an exposure unit, a developer, a transfer unit, and a fuser apparatus. The charger, the exposure unit, the developer, the transfer unit, and the fuser apparatus are disposed around the photoconductor drum. In this embodiment, the toner is positively charged, so that the toner attaches to the sheet, which is conveyed to the fuser apparatus.

Figure 1:
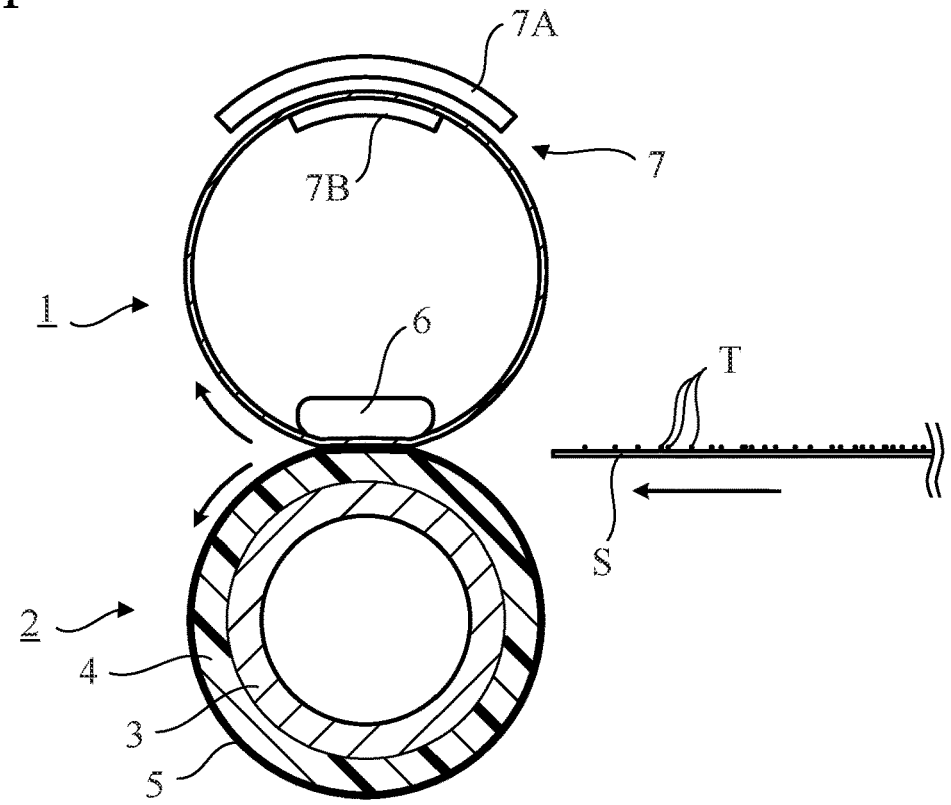
FIG. 1 is a schematic cross-sectional view showing an example of a fuser apparatus including a fuser device according to an embodiment of the present invention.

As shown in FIG. 1, the fuser apparatus has a movable fuser belt (fuser device) 1 and a rotatable pressure roll 2. While the sheet S passes through the nip between the fuser belt 1 and the pressure roll 2, toner particles T are fixed to the sheet S. The fuser belt 1 and the pressure roll 2 pressurize the toner particles T on the sheet S. The fuser belt 1 fuses the toner particles T by heating.

The pressure roll 2 includes a core member 3, an elastic layer 4 covering the outer periphery of the core member 3, and a release layer 5 covering the outer periphery of the elastic layer 4.

The core member 3 is a hard round rod. The material of the core member 3 is not limited, but may be, for example, a metal such as iron, aluminum, etc. or a resin material. The core member 3 may be hollow or solid.

The elastic layer 4 is a hollow cylinder mounted to the outer peripheral surface of the core member 3 over the entire circumference, and is formed of sponge.

The release layer 5 is a thin layer mounted to the outer peripheral surface of the elastic layer 4 over the entire circumference, and facilitates separation of the pressure roll 2 from the toner particles T fixed to the sheet P. Although FIG. 1 shows that a toner image is formed on one surface of the sheet P, it is of note that after the toner particles T are fixed to one surface of the sheet P, the toner particles T may be fixed to the other surface of the sheet P. In this case, the toner particles T are brought into contact with the pressure roll 2 in the nip.

The release layer 5 is formed of a synthetic resin material that can be easily separated from the toner particles T. The material of the release layer 5 is preferably a fluororesin. Such a fluororesin is, for example, a perfluoroalkoxyfluororesin (PFA), polytetrafluoroethylene (PTFE), a tetrafluoroethylene-hexafluoropropylene copolymer (FEP), or a tetrafluoroethylene-ethylene copolymer (ETFE).

The fuser belt 1 is a hollow cylinder, and can also be considered as a roll with a cylindrical wall having a small thickness. A fixing pad 6 made of a resin is disposed inside the fuser belt 1. The fixing pad 6 presses the fuser belt 1 against the pressure roll 2 to maintain an appropriate width of the nip between the fuser belt 1 and the pressure roll 2. In the nip, the fuser belt 1 and the pressure roll 2 are slightly deformed under mutual pressure.

In the vicinity of the fuser belt 1, a heater 7 is disposed. The heater 7 reheats the fuser belt 1 cooled as a result of being deprived of heat by the pressure roll 2 at the nip. In the example shown in FIG. 1, the heater 7 has a known electromagnetic induction heater 7A and a magnetic field absorber 7B, in which the electromagnetic induction heater 7A is disposed outside the fuser belt 1 and the magnetic field absorber 7B is disposed inside the fuser belt 1.

However, the type of the heater is not limited to the example shown in FIG. 1. For example, as shown in FIG. 2, a heat generating source such as a halogen heater 8 disposed inside the fuser belt 1 may be used as the heater.

Figure 2:
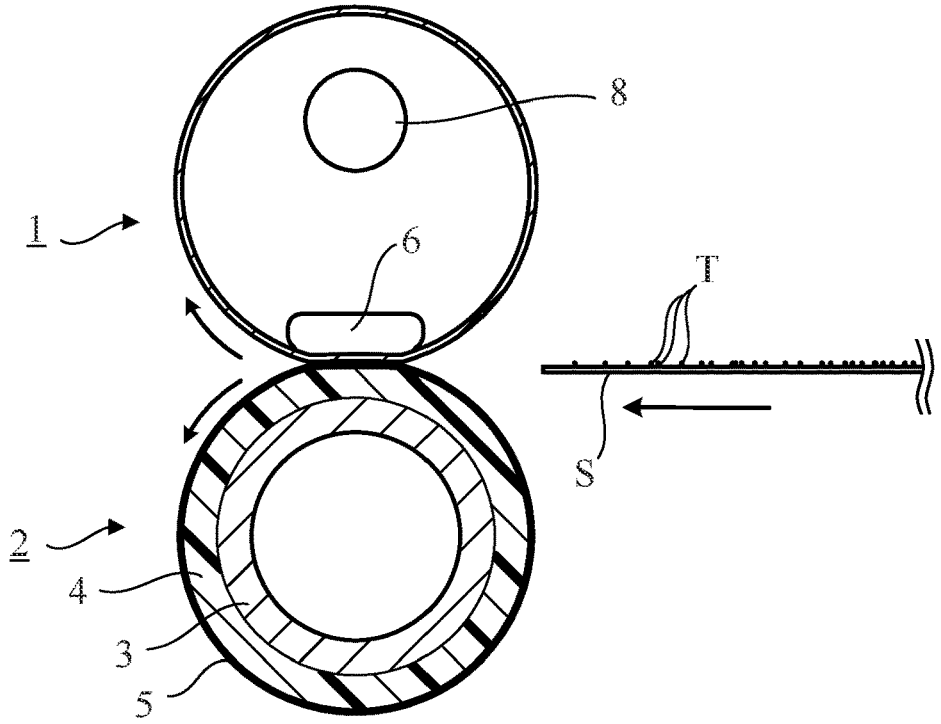
FIG. 2 is a schematic cross-sectional view showing another example of a fuser apparatus including a fuser device according to an embodiment.

In the examples of FIGS. 1 and 2, the fixing pad 6 is used, but a rotatable fuser roll may be disposed inside the fuser belt 1 instead of the fixing pad 6.

Figure 3:
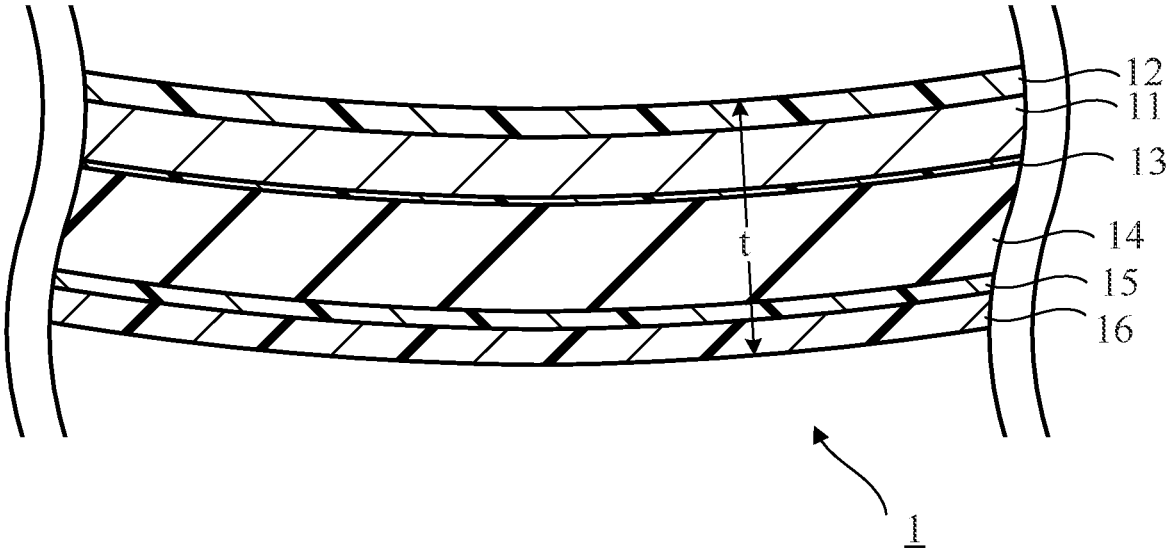
FIG. 3 is a cross-sectional view of a portion of a fuser device according to an embodiment.

As shown in FIG. 3, the fuser belt 1 has a substrate 11, a slide layer 12, a primer layer 13, a rubber layer 14, an adhesion layer 15, and a surface layer 16.

The substrate 11 is a hollow metal cylinder. The material of the substrate 11 may be, for example, nickel or stainless steel. The substrate 11 may be formed by sandwiching a copper layer between one nickel layer and another nickel layer. The substrate 11 ensures rigidity of the fuser belt 1 and enhances thermal conductivity of the fuser belt 1.

The slide layer 12 is a layer of uniform thickness that coats the inner periphery of the substrate 11. The slide layer 12 slidably contacts the fixing pad 6 and/or other components of the fuser apparatus. The slide layer 12 is made of a material having a low coefficient of friction, for example, a fluororesin. A preferred fluororesin is, for example, PTFE, PFA, FEP, or ETFE.

The primer layer 13 is a layer of uniform thickness that covers an outer periphery of the substrate 11. The primer layer 13 has a role in bonding the slide layer 12 and the rubber layer 14. The material of the primer layer 13 may vary depending on the material of the rubber layer 14.

The rubber layer 14 is a layer of uniform thickness that covers an outer periphery of the primer layer 13. The rubber layer 14 is the thickest layer of the fuser belt 1. The rubber layer 14 imparts appropriate elasticity to the fuser belt 1 for fixing the toner particles T. The rubber layer 14 is made of, for example, silicone rubber. In a case in which the rubber layer 14 is made of silicone rubber, it is preferable that the primer layer 13 is made of a silicone rubber-based adhesive.

The adhesion layer 15 is a layer of uniform thickness that covers the outer periphery of the rubber layer 14. The adhesion layer 15 has a role in bonding the rubber layer 14 and the surface layer 16. The adhesion layer 15 is made of, for example, a silicone rubber-based adhesive or a fluororesin-based adhesive.

The surface layer 16 is a layer of uniform thickness that covers the outer periphery of the adhesion layer 15. The surface layer 16 facilitates separation of the fuser belt 1 from the toner particles T fixed to sheets P. The surface layer 16 is made of a synthetic resin material that can be easily separated from the toner particles T. The material of the surface layer 16 is preferably a fluororesin. A preferred fluororesin is, for example, PFA, PTFE, FEP, or ETFE.

However, other layers may be interposed between the above-mentioned layers.

Hereinafter, a method of manufacturing the fuser belt 1 will be described.

Figure 4:
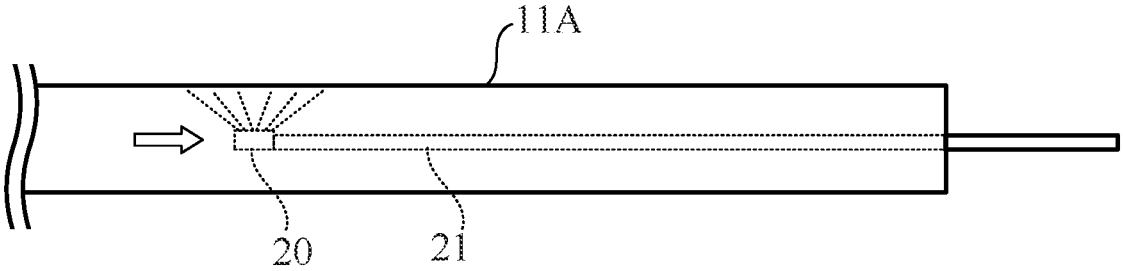
FIG. 4 is a schematic diagram showing a step of manufacturing the fuser device according to the embodiment.

First, as shown in FIG. 4, a metal tube 11A shaped as a hollow cylinder is prepared. The metal tube 11A corresponds to the substrate 11 in the fuser belt 1 (finished product), but has a length several times that of the fuser belt 1 of the finished product. The metal tube 11A can be manufactured, for example, by electroforming.

Next, as shown in FIG. 4, a spray nozzle 20 is inserted into the interior of the metal tube 11A, and while moving the spray nozzle 20, the material of the slide layer 12 is supplied to the spray nozzle 20 via a tube 21, and the spray nozzle 20 sprays the material of the slide layer 12. Thereafter, the material is cured by heating to form a slide layer 12.

Figure 5:
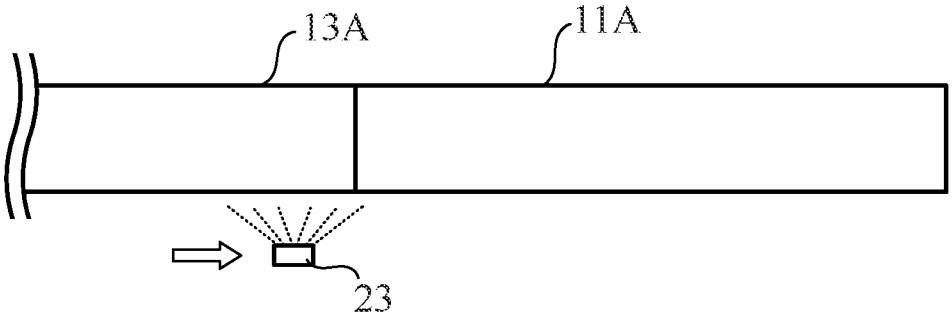
FIG. 5 is a schematic diagram showing a step after the step of FIG. 4.

Next, as shown in FIG. 5, while moving another spray nozzle 23, the material 13A of the primer layer 13 is sprayed onto the outer peripheral surface of the metal tube 11A from the spray nozzle 23. Thereafter, the primer layer 13 is formed by heating to dry the material 13A.

Figure 6:
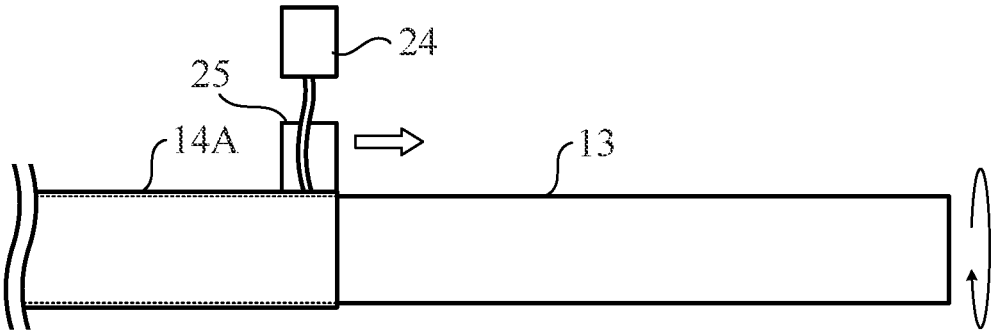
FIG. 6 is a schematic diagram showing a step after the step of FIG. 5.

Next, as shown in FIG. 6, the metal tube 11A is rotated about the axis thereof, and while the material 14A of the rubber layer 14 is supplied to the outer peripheral surface of the primer layer 13 by a rubber supply device 24, the material 14A of the rubber layer 14 is leveled evenly (to have a uniform thickness) by a blade 25 with a straight tip end. In this way, the surface of the primer layer 13 is coated with the material of the rubber layer 14. Thereafter, the rubber layer 14 is formed by heating to cure the material 14A.

Figure 7:
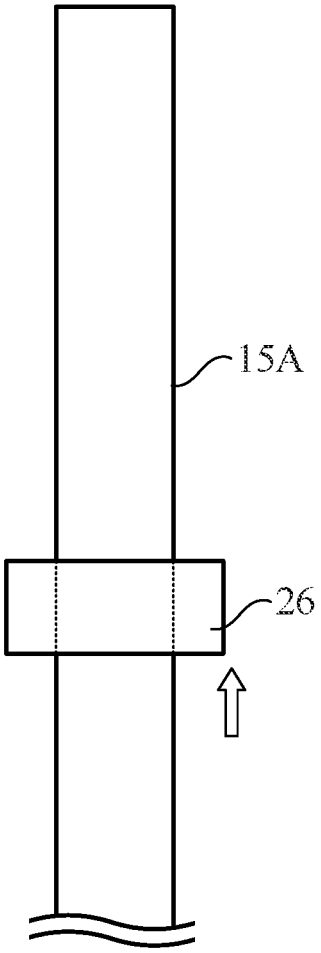
FIG. 7 is a schematic diagram showing a step after the step of FIG. 6.

Next, as shown in FIG. 7, the material 15A of the adhesion layer 15 is applied around the rubber layer 14, and the metal tube 11A is inserted into a ring 26. By moving the ring 26 along the axial direction of the metal tube 11A, the material 15A is leveled evenly (to have a uniform thickness) by the inner peripheral surface of the ring 26.

Figure 8:
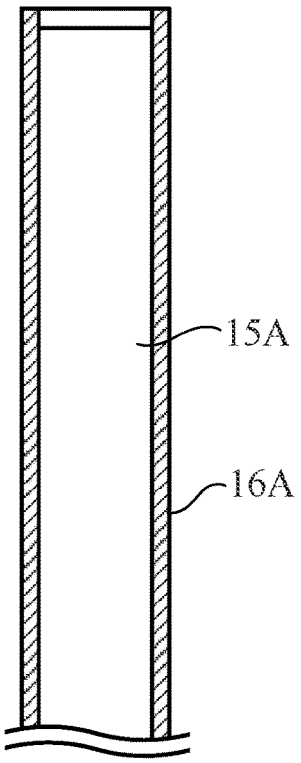
FIG. 8 is a schematic diagram showing a step after the step of FIG. 7.

Next, as shown in FIG. 8, a tube 16A is placed around the material 15A of the adhesion layer 15. In other words, the metal tube 11A is inserted into the tube 16A. The tube 16A corresponds to the surface layer 16 in the fuser belt 1 (finished product), but has a length several times that of the fuser belt 1 of the finished product.

Figure 9:
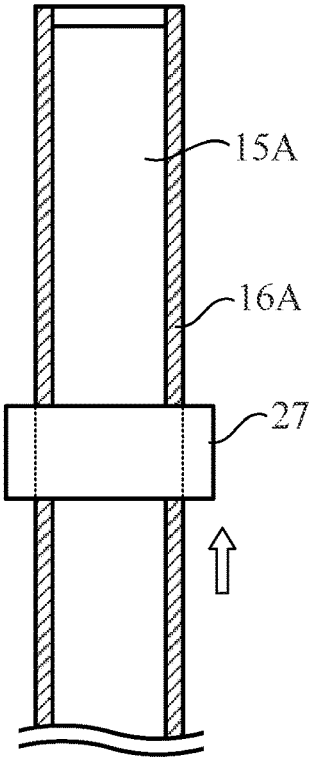
FIG. 9 is a schematic diagram showing a step after the step of FIG. 8.

Next, as shown in FIG. 9, the metal tube 11A is inserted into a ring 27 together with the tube 16A. By moving the ring 27 along the axial direction of the metal tube 11A, the tube 16A is pressed radially inward by the inner peripheral surface of the ring 27, thereby enhancing adhesion of the material 15A of the adhesion layer 15 and the tube 16A. In FIGS. 8 and 9, only the tube 16A is shown in a cross section. Thereafter, the material 15A is heated and cured, so that the adhesion layer 15 is formed, and (at the same time,) the adhesion layer 15 and the tube 16A are fixed.

Figure 10:
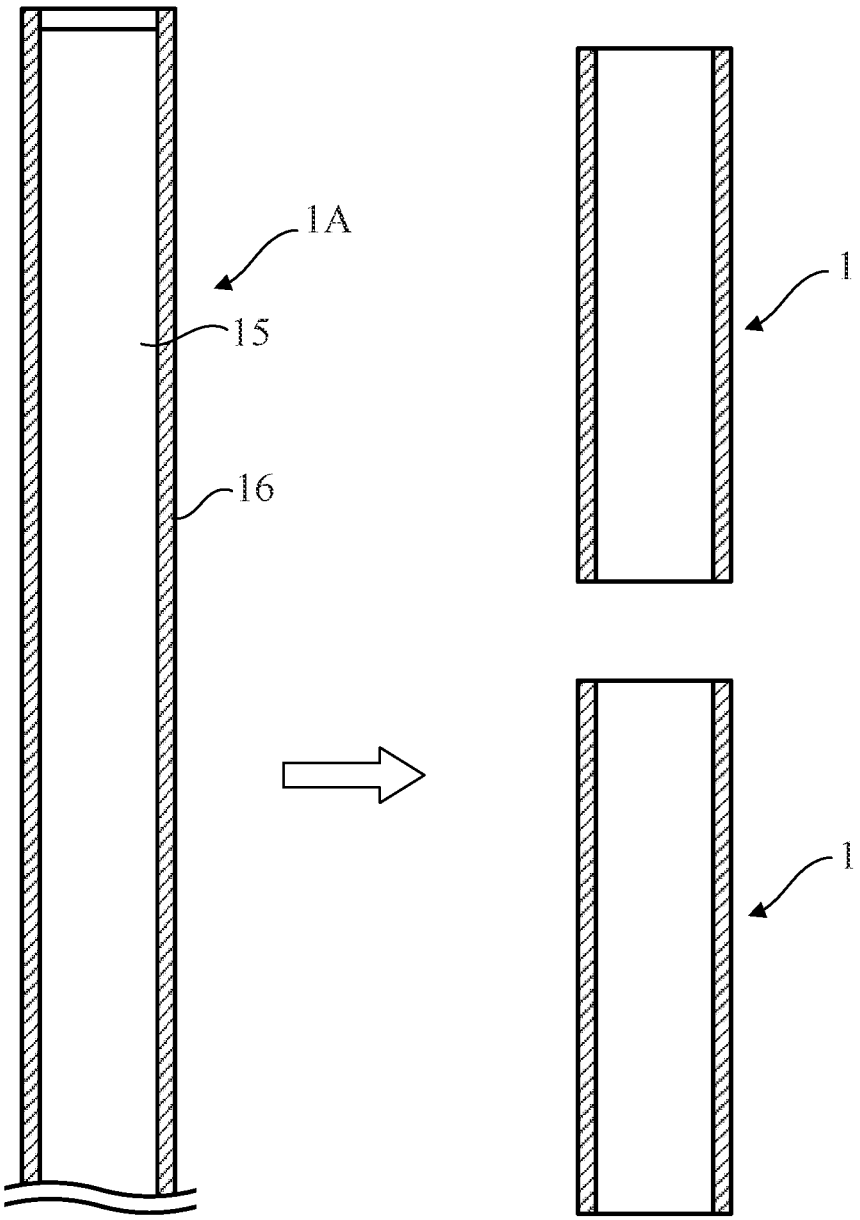
FIG. 10 is a schematic diagram showing a step after the step of FIG. 9.

In this manner, the long hollow cylinder 1A shown in FIG. 10 is obtained. Then, as shown in FIG. 10, by cutting the hollow cylinder 1A in a direction perpendicular to the axial direction, fuser belts 1 are obtained as finished products.

The applicant produced samples of different materials and thicknesses of several layers of the fuser belt 1, measured electrical properties of samples, and investigated whether each sample effectively reduced electrostatic offset. Factors of the samples are shown in FIGS. 11A and 11B.

For each sample, the substrate 11, the slide layer 12, and the primer layer 13 were common. Specifically, the substrate 11 was a seamless hollow nickel cylinder manufactured by use of electroforming, having a diameter of 40 mm and a thickness of 40 μm. The slide layer 12 was formed of PTFE and had a thickness of 12 μm.

The primer layer 13 was manufactured from "DY 39-042" manufactured by Dow Corning Toray Co., Ltd. (Tokyo, Japan), which is a non-conductive silicone rubber-based adhesive. As described above, the material 13A of the primer layer 13 was applied on the metal tube 11A by a spray nozzle 20, and heated at 150 degrees Celsius for 1 minute to dry the material 13A, thereby forming a primer layer 13. The thickness of the primer layer 13 was 2 μm.

For each sample except for sample 9, the rubber layer 14 was manufactured from "X-34-2008-2" manufactured by Shin-Etsu Chemical Co., Ltd. (Tokyo, Japan), which is a non-conductive silicone rubber. For sample 9, the rubber layer 14 was manufactured from "X-34-2525," which is a conductive silicone rubber containing carbon particles as a conductor. As described above, the material 14A of the rubber layer 14 was leveled by the blade 25 and cured by heating at 150 degrees Celsius.

The thickness of the rubber layer 14 in each sample was as shown in FIGS. 11A and 11B. The thickness of the rubber layer 14 of samples 5 to 7 was made significantly different from that of other samples in order to examine differences in electrical characteristics caused by differences in thickness of the rubber layer 14. In the fuser belt 1, the layers other than the substrate 11 are basically formed using dielectrics, unless it is specified that a conductor is used as in FIGS. 11A and 11B. The electrostatic capacity between the substrate 11 and the surface of the surface layer 16 in the fuser belt 1 becomes smaller as the thickness of the dielectrics between the substrate 11 and the surface of the surface layer 16 becomes greater. The applicant considered that the smaller the electrostatic capacity, the lesser the charging on the surface of the surface layer 16, which is close to the toner particles T, and the lesser the electrostatic offset.

For samples 1, 2, and 5 to 8, the adhesion layer 15 was manufactured from "KE-1880" manufactured by Shin-Etsu Chemical Co., Ltd., which is a non-conductive silicone rubber-based adhesive. For sample 3 and 4, the adhesion layer 15 was manufactured from "PJ-CL990" manufactured by The Chemours Company (Delaware, USA), which is a non-conductive fluororesin-based adhesive. Although the material 15A of the adhesion layer 15 is in an emulsion state, it is considered that the cured adhesion layer 15 of samples 3 and 4 contains fluorine of high purity. For samples 9 and 10, the adhesion layer 15 was manufactured from "X-34-3280" manufactured by Shin-Etsu Chemical Co., Ltd., which is a conductive silicone rubber-based adhesive containing carbon particles as a conductor. For sample 11, the adhesion layer 15 was manufactured from "SIFEL2617" manufactured by Shin-Etsu Chemical Co., Ltd., which is a non-conductive fluoro rubber-based adhesive. The thickness of the adhesion layer 15 in each sample was as shown in FIGS. 11A and 11B.

The reason for the variation in the material of the adhesion layer 15 depending on the sample was to examine the difference in electrical characteristics caused by the difference in the material of the adhesion layer 15. The applicant thought that the presence of fluorine, which has a high electronegativity (strong force to attract electrons), between the substrate 11 and the surface of the surface layer 16 in the fuser belt 1 reduces charging on the surface of the surface layer 16, which is adjacent to the toner particles T, thereby reducing electrostatic offset. The electronegativity of fluorine is 3.98 and the largest among all atoms, whereas the electronegativity of silicon, which is the main component of silicone rubber, is 1.90.

For each sample, the surface layer 16 was produced from a tube made of PFA with a thickness of 30 μm. However, for the surface layer 16 of samples 1 and 2, "Low Charging PFA Tube", which is an ion-conductive PFA tube manufactured by Junkosha Inc. (Tokyo, Japan) was used. For samples 3-9 and 11, an insulative PFA tube manufactured by Gunze Limited (Osaka, Japan) from "PFA 451HP-J" manufactured by Chemours-Mitsui Fluoroproducts Co., Ltd. (Tokyo, Japan) was used as the surface layer 16. For sample 10, a tube with two layers manufactured by Gunze Limited was used as the surface layer 16. In the tube with two layers, the outer layer was formed from an insulative PFA ("PFA 451HP-J" manufactured by Chemours-Mitsui Fluoroproducts Co., Ltd.) having a thickness of 15 μm, and the inner layer was formed from a conductive PFA having a thickness of 15 μm. The sheet resistance of the inner layer of the surface layer 16 of sample 10 was $1\times10^7$ ohms per square.

The reason for the difference in the material of the surface layer 16 from sample to sample was to investigate differences in electrical characteristics resultant from the difference in the material of the surface layer 16. The applicant considered that electrostatic offset could be reduced if electric charges on the surface of the surface layer 16 proximate to the toner particles T were easy to move. Accordingly, the applicant expected that in samples 1 and 2 in which the surface layer 16 is manufactured from an ion-conductive PFA tube, electrostatic offset could be reduced.

The characteristics of each sample are summarized as follows.

Samples 1 and 2 are characterized in that the surface layer 16 is made of an ion-conductive PFA tube. In samples 1 and 2, the material and thickness of each layer are the same. However, prior to investigation of electrical properties and electrostatic offset described below, sample 2 was heated at 230 degrees Celsius for 120 hours, thereby volatilizing the ionic conductive material of the surface layer 16 in order to degrade the charge decay feature. The temperature of 230 degrees Celsius was determined in consideration of usage environments of the fuser belt 1. Sample 1 was not subjected to such heat treatment.

Samples 3 and 4 are characterized in that the material of the adhesion layer 15 is fluororesin-based. The difference in samples 3 and 4 is the thickness of the adhesion layer 15.

Samples 5-7 are characterized by a noticeably different thickness of the rubber layer 14 in comparison with other samples. Samples 5-7 have rubber layers 14 of different thicknesses.

Sample 8 was not subjected to improvement to reduce electrostatic offset.

Samples 9 and 10 are characterized in that the adhesion layer 15 contains carbon particles as a conductor. Furthermore, sample 9 differs from sample 10 in that the rubber layer 14 also contains carbon particles as a conductor.

Sample 11 is characterized in that the adhesion layer 15 is fluoro rubber-based.

Figure 12:
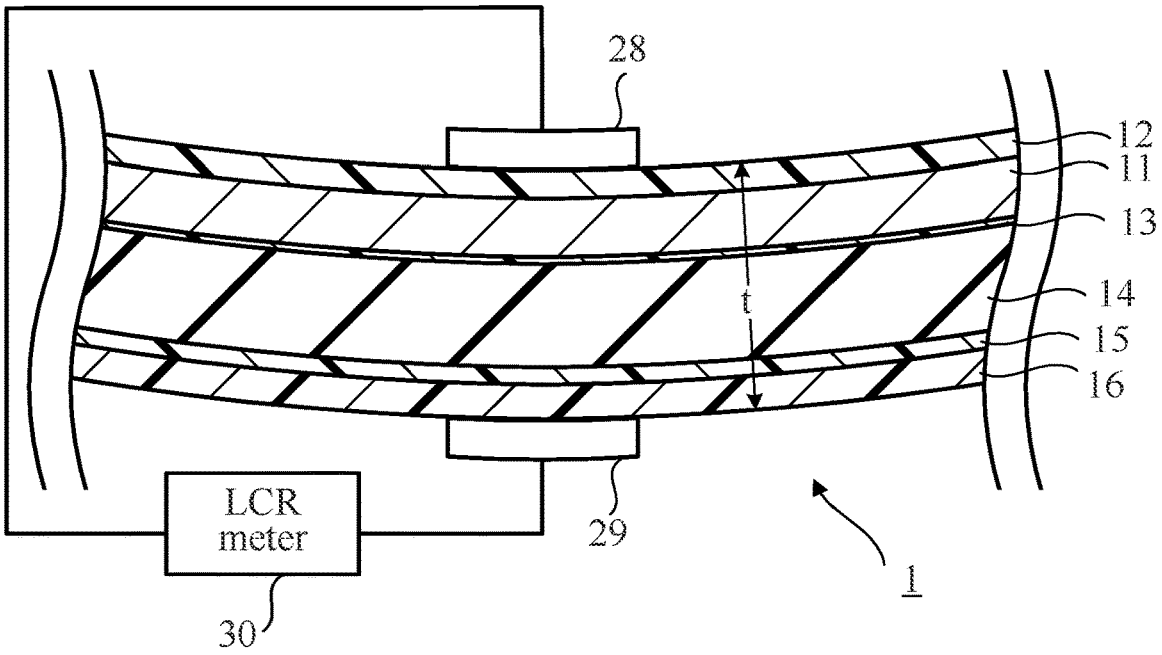
FIG. 12 is a schematic diagram showing a method of measuring the electrostatic capacity in the thickness direction of the fuser device according to an embodiment.

For each sample, the electrostatic capacity pF in the thickness direction of the fuser belt 1 was measured in the manner depicted in FIG. 12. The electrostatic capacity is an index representing ease of charging the fuser belt 1. The manner depicted is two-terminal sensing, in which two electrodes 28 and 29 are brought into contact with the inner peripheral surface of the fuser belt 1 (the surface of the slide layer 12) and the outer peripheral surface of the fuser belt 1 (the surface of the surface layer 16), respectively, to measure the electrostatic capacity with an LCR meter 30. The LCR meter 30 used was "3522-50" manufactured by Hioki E.E. Corporation (Nagano, Japan). Furthermore, for general considerations, the measured electrostatic capacity was divided by the area of the electrodes 28 and 29 (contact area to the fuser belt 1) to calculate the electrostatic capacity per unit area C in the thickness direction of the fuser belt 1. FIGS. 11A and 11B show the electrostatic capacity per unit area C ($pF/cm^2$) in the thickness direction of the fuser belt 1.

Figure 13:
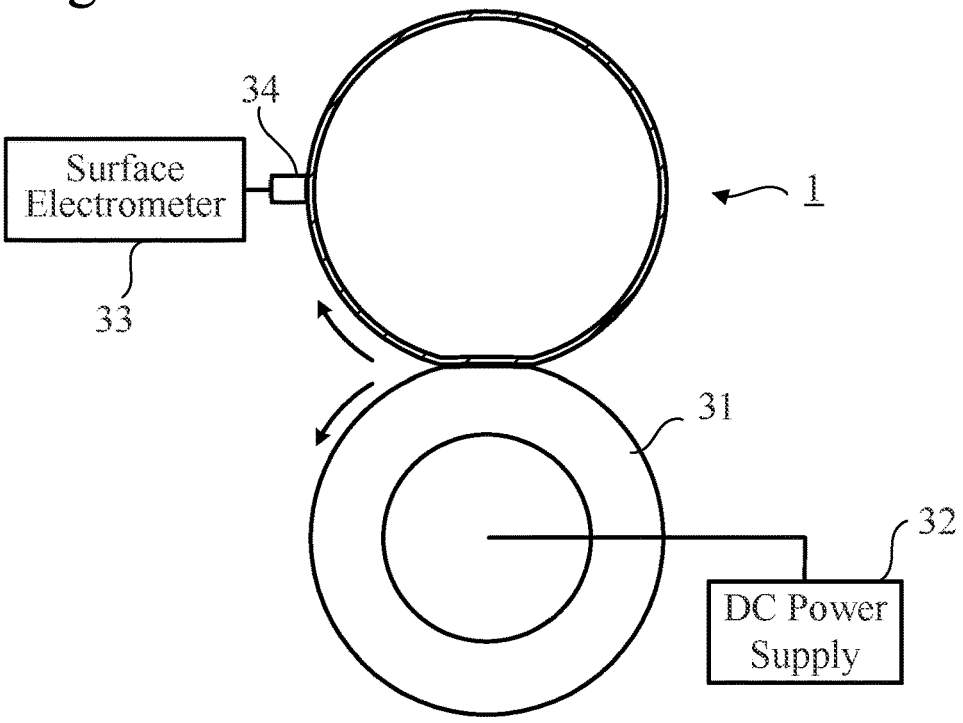
FIG. 13 is a schematic diagram showing a method of measuring the charge decay on the surface layer of the fuser device according to the embodiment.

Furthermore, for each sample, the amount of charge decay ΔV (kV) in the surface layer 16 was measured in the manner depicted in FIG. 13. In this measurement, under an environment in which the temperature was 23 degrees Celsius and the relative wetness was 55%, a charging roll 31 was brought into contact with the fuser belt 1, the fuser belt 1 was revolved at 60 rpm, and charges were supplied from the DC (direct current) power supply 32 to the fuser belt 1 via the charging roll 31. The resistance of the charging roll 31 was $5\times10^6\Omega$. The DC power supply 32 was "610C" manufactured by Trek, Inc. (New York, USA).

The probe 34 of a surface electrometer 33 was brought into proximity with the outer peripheral surface of the fuser belt 1 (surface of the surface layer 16) to measure the surface potential. The proximity position of the probe 34 to the fuser belt 1 was 90 degrees away from the position at which the charging roll 31 was in contact with the fuser belt 1. The surface electrometer 33 was "Model 244A" of Monroe Electronics, Inc. (New York, USA), and the probe was a standard probe "1017A" attached to "Model 244A."

Under the above conditions, the surface potential of the surface layer 16 was monitored by the surface electrometer 33, and the surface of the surface layer was maintained to be charged to −1 kV for 60 seconds. Thereafter, the charging roll 31 was separated from the fuser belt 1, thereby finishing the charging. 120 seconds after end of charging, charge decay ΔV (kV) of the surface of the surface layer 16 was measured. Charge decay ΔV is an index representing the difficulty of charging of the fuser belt 1. The measured charge decay ΔV is shown in FIGS. 11A and 11B. Furthermore, for general considerations, a value (charge decay per thickness) ΔV/t obtained by dividing the charge decay ΔV by the thickness t of the fuser belt 1 (see FIGS. 3 and 12) was calculated. The value ΔV/t (V/μm) is also shown in FIGS. 11A and 11B.

Furthermore, for general considerations, a ratio Ct/ΔV of the electrostatic capacity per unit area C in the thickness direction of the fuser belt 1 to the value ΔV/t was calculated. The ratio Ct/ΔV (pF/Vμm) is also shown in FIGS. 11A and 11B (excluding samples with zero charge decay ΔV).

Each sample was mounted to an image forming apparatus, and the effect for reducing electrostatic offset of each sample was evaluated. The image forming apparatus used was "TASKalfa 5550ci" manufactured by Kyocera Document Solutions Inc. (Osaka, Japan). In this assessment, a white solid image was printed on sheets of paper, and the L* value (lightness) were measured at seven spots in the image with the use of a color difference meter (chroma meter, "CR-400" manufactured by Konica Minolta, Inc. (Tokyo, Japan)) in order to determine whether fogging (printing on a non-print area) occurred. It was evaluated that in a case in which the L* value was 95.5 or more, fogging did not exist or was negligible, and the electrostatic offset reducing effect was good. It was evaluated that in a case in which the L* value was less than 95.5, fogging was not negligible and the electrostatic offset reducing effect was poor.

The evaluation results are shown in FIGS. 11A and 11B. The electrostatic offset reducing effect was good for samples 1 to 6, whereas the electrostatic offset reducing effect was poor for samples 7 to 11.

Therefore, it was found that samples 1 and 2, in which the surface layer 16 is made of the ion conductive PFA tube, can effectively reduce electrostatic offset. It was found that samples 3 and 4, in which the material of the adhesion layer 15 is fluororesin-based, can also effectively reduce the electrostatic offset. On the other hand, it was found that sample 11, in which the material of the adhesion layer 15 is fluoro rubber-based, cannot effectively reduce the electrostatic offset. It has been found that even if the material of the adhesion layer 15 is non-conductive silicone rubber-based, samples 5 and 6, in which the thickness of the rubber layer 14 is as large as 800 μm or 1000 μm, can effectively reduce the electrostatic offset.

Figure 14:
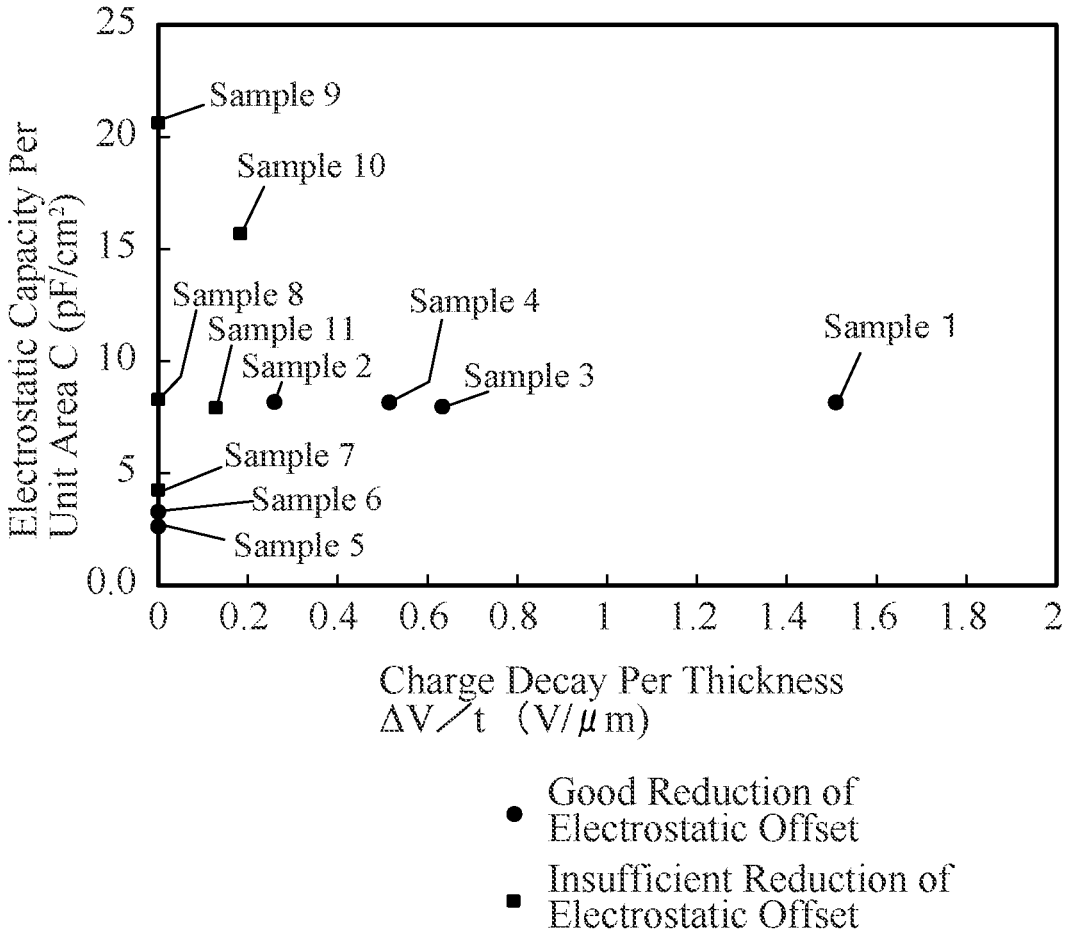
FIG. 14 is a graph showing electrical characteristics for each sample.

FIG. 14 is a graph showing the relation between the value ΔV/t (V/μm) and the electrostatic capacity per unit area C ($pF/cm^2$) in the thickness direction for each samples. In the graph shown, the circular dots depict a good electrostatic offset reducing effect, whereas the square dots depict a poor electrostatic offset reducing effect.

As is apparent from FIGS. 11A, 11B, and 14, for samples 5-9, in which the charge decay ΔV is zero (and hence the charge decay per thickness ΔV/t is zero), it can be understood that the electrostatic offset reducing effect depends on the electrostatic capacity per unit area C. More specifically, samples 5 and 6, in which the electrostatic capacity per unit area C was equal to or less than 3.30 pF/cm$^2$, were able to effectively reduce electrostatic offset, whereas samples 7 to 9 were not able to reduce electrostatic offset. Thus, for the fuser belt 1 in which the charge decay ΔV at a moment 120 seconds after end of charging the surface of the surface layer to −1 kV is zero, it is preferable that the electrostatic capacity per unit area C in the thickness direction of the fuser device 1 be equal to or less than 3.30 pF/cm$^2$. In this preferred aspect, even if the charge decay ΔV is zero, since the electrostatic capacity per unit area C in the thickness direction of the fuser device 1 is sufficiently small, charging on the surface of the surface layer 16 is reduced, and it is possible to effectively reduce the electrostatic offset.

As is apparent from FIGS. 11A, 11B, and 14, for samples 1 to 4, 10, and 11, in which the charge decay ΔV is greater than zero, it was found that even if the electrostatic capacity per unit area C is similar, the electrostatic offset reducing effect varies. More specifically, samples 1 to 4 were able to effectively reduce the electrostatic offset, but sample 11 was not. Thus, it can be understood that in a case in which the electrostatic capacity is high to some extent, electrostatic offset is likely to occur by charging, but if the charge decay effect is high, charging is restricted, thereby reducing electrostatic offset. The applicant focuses on the ratio Ct/ΔV of the electrostatic capacity per unit area C to the amount of charge decay per thickness ΔV/t, and considers that the electrostatic offset reducing effect depends on the ratio Ct/ΔV. Accordingly, for the fuser belt 1 in which the charge decay ΔV at a moment 120 seconds after end of charging the surface of the surface layer to −1 kV is greater than 0, it is preferable that the ratio Ct/ΔV of the electrostatic capacity per unit area C in the thickness direction of the fuser device 1 to the value ΔV/t obtained by dividing the charge decay ΔV by the thickness t of the fuser device 1 be equal to or less than $3.13\times10^9$ pF/Vμm. In this preferred aspect, since the charge decay ΔV is large to some extent and the electrostatic capacity C is small to some extent, charging on the surface of the surface layer 16 is reduced, and it is possible to effectively reduce the electrostatic offset.

The present invention has been shown and described with references to preferred embodiments thereof. However, it will be understood by those skilled in the art that various changes in form and details may be made therein without departing from the scope of the invention as defined by the claims. Such variations, alterations, and modifications are intended to be encompassed in the scope of the present invention.

For example, the slide layer 12 is not essential.

REFERENCE SYMBOLS

1: Fuser belt (fuser device)
11: Substrate
12: Slide layer
13: Primer layer
14: Rubber layer
15: Adhesion layer
16: Surface layer

The invention claimed is:

1. A tubular fuser device that rotates and is in contact with a sheet on which a positively charged toner image is formed to fix the toner image to the sheet, the fuser device comprising:

a tubular substrate made of a metal;

a rubber layer covering an outer periphery of the substrate;

an adhesion layer covering an outer periphery of the rubber layer; and a surface layer made of a resin covering an outer periphery of the adhesion layer, a charge decay ΔV at a moment 120 seconds after end of charging a surface of the surface layer to −1 kV being zero, wherein an electrostatic capacity per unit area C in a thickness direction of the tubular fuser device is equal to or less than 3.30 pF/cm$^2$, and wherein the electrostatic capacity per unit area C in the thickness direction is measured with two electrodes brought into contact with an inner peripheral surface of the tubular fuser device and an outer peripheral surface of the tubular fuser device, respectively.

2. A tubular fuser device that rotates and is in contact with a sheet on which a positively charged toner image is formed to fix the toner image to the sheet, the fuser device comprising:

a tubular substrate made of a metal, a rubber layer covering an outer periphery of the substrate, an adhesion layer covering an outer periphery of the rubber layer, and a surface layer made of a resin covering an outer periphery of the adhesion layer, a charge decay ΔV at a moment 120 seconds after end of charging a surface of the surface layer to −1 kV being greater than zero, wherein a ratio Ct/ΔV of an electrostatic capacity per unit area C in a thickness direction of the tubular fuser device to a value ΔV/t obtained by dividing the charge decay ΔV by a thickness t of the tubular fuser device including the tubular substrate, the rubber layer, and adhesion layer, and the surface layer is equal to or less than $3.13\times10^9$ pF/V μm, wherein the electrostatic capacity per unit area C in the thickness direction is measured with two electrodes brought into contact with an inner peripheral surface of the tubular fuser device and an outer peripheral surface of the tubular fuser device, respectively.

* * * * *